US009193031B2

(12) United States Patent
Schwaiger et al.

(10) Patent No.: US 9,193,031 B2
(45) Date of Patent: Nov. 24, 2015

(54) TOOL REST WITH ANGLE INDICATOR FOR USE WITH BENCH GRINDER

(71) Applicants: Barry M. Schwaiger, Murfreesboro, TN (US); Charles Weber, Onalaska, WI (US)

(72) Inventors: Barry M. Schwaiger, Murfreesboro, TN (US); Charles Weber, Onalaska, WI (US)

(73) Assignee: JPW Industries Inc., La Vergne, TN (US)

( * ) Notice: Subject to any disclaimer, the term of this patent is extended or adjusted under 35 U.S.C. 154(b) by 51 days.

(21) Appl. No.: 13/936,295

(22) Filed: Jul. 8, 2013

(65) Prior Publication Data

US 2015/0011143 A1 Jan. 8, 2015

(51) Int. Cl.

| | |
|---|---|
| ***B24B 41/00*** | (2006.01) |
| ***B24B 41/06*** | (2012.01) |
| ***B24B 49/00*** | (2012.01) |
| ***B24B 27/02*** | (2006.01) |

(52) U.S. Cl.
CPC ..... *B24B 41/066* (2013.01); *B24B 27/02* (2013.01); *B24B 49/00* (2013.01)

(58) Field of Classification Search
CPC ..... B24B 41/066
USPC ..... 451/410
See application file for complete search history.

(56) References Cited

U.S. PATENT DOCUMENTS

| | | | | |
|---|---|---|---|---|
| 709,177 | A * | 9/1902 | Schofiled | 451/410 |
| 894,338 | A * | 7/1908 | McLeran | 451/410 |
| 1,605,784 | A * | 11/1926 | Schmitt | 451/370 |
| 2,555,707 | A * | 6/1951 | Scott | 451/410 |
| 2,623,337 | A * | 12/1952 | Falls | 451/410 |
| 3,436,872 | A | 4/1969 | Warren | |
| 3,501,871 | A * | 3/1970 | Anderson et al. | 451/406 |
| 3,861,088 | A * | 1/1975 | Grieco | 451/380 |
| 5,172,484 | A * | 12/1992 | Triola | 33/534 |
| 6,848,971 | B2 | 2/2005 | Doman | |
| 7,987,608 | B2 * | 8/2011 | Rowe | 33/370 |
| 2012/0270479 | A1 | 10/2012 | Batty | |

FOREIGN PATENT DOCUMENTS

| | | |
|---|---|---|
| GB | 540850 | 10/1941 |
| WO | 2007113510 A1 | 10/2007 |

OTHER PUBLICATIONS

Jet 8-inch Bench Grinder Model JWBG-8. Operating Instructions and Parts Manual. Mar. 3, 2014. [retrieved on Mar. 10, 2014]. Retrieved from the internet, 20 pages.

* cited by examiner

*Primary Examiner* — Maurina Rachuba
(74) *Attorney, Agent, or Firm* — Schiff Hardin LLP

(57) ABSTRACT

A bench grinder has a tool rest mounted on a bracket and disposed adjacent a grinding wheel of the grinder. The tool rest has a tool rest platform that is connected to the bracket by a pivot connection and that may be secured in different angular positions by a bolt, such as a hand bolt. The bracket end to which the platform is affixed is provided with a cylindrical surface portion marked with angle marks. An opening is provided in the tool rest platform through which the angle marked surface is visible. An indicator line on the tool rest platform aligns to the angle mark to indicate the angle of the platform.

8 Claims, 4 Drawing Sheets

TOOL REST WITH ANGLE INDICATOR FOR USE WITH BENCH GRINDER

BACKGROUND OF THE INVENTION

1. Field of the Invention

The present invention relates generally to a bench grinder, and more particularly to a tool rest for use with a bench grinder.

2. Description of the Related Art

Bench grinders generally have one or more abrasive wheels rotating on an axle and driven by a motor. Work articles are moved into contact with the rotating abrasive wheel to abrade material from the work article, such as to shape the work article to a desired shape. Abrasive wheels or grinding wheels may be used to sharpen tools, such as knives, chisels, gouges, plane blades, drill bits, scissors, hedge shears, clippers, snips, axes, or other tools. Work articles may be supported in the user's hands while pressed against the abrading wheel or may be supported on a work article support. When the work article is to be shaped with a particular shape or angle or when control of the work article is desired during grinding, a work article support is provided.

Work article supports are provided in a variety of types and shapes. A common work article support is a tool support, which provides a flat surface adjacent the face of the grinding wheel on which the work article is supported during grinding. The tool supports may be fixed or adjustable.

A tool such as a chisel or gouge such as used to cut material during turning of material on a lathe has a desired angle for sharpening. A tool rest on which to position the tool during sharpening preferably may be set to the desired angle during sharpening of the tool using a bench grinder or the like.

SUMMARY OF THE INVENTION

The present invention provides an angle-adjustable tool rest for use on a bench grinder or other abrading or gridding device. The angle-adjustable tool rest is adjustable at various angles relative to the grinding surface of the grinder or other grinding device. An angle indicator is provided for the tool rest so that the user may determine the angle at which the tool rest surface is disposed. The angle indicator of a preferred embodiment includes a window opening in the tool rest surface through which is visible an angle indicator gauge. As the tool rest is adjusted to different angles, the angle indicator gauge shows the angle of the tool rest to the user.

DETAILED DESCRIPTION OF THE PREFERRED EMBODIMENTS

Figure 1:
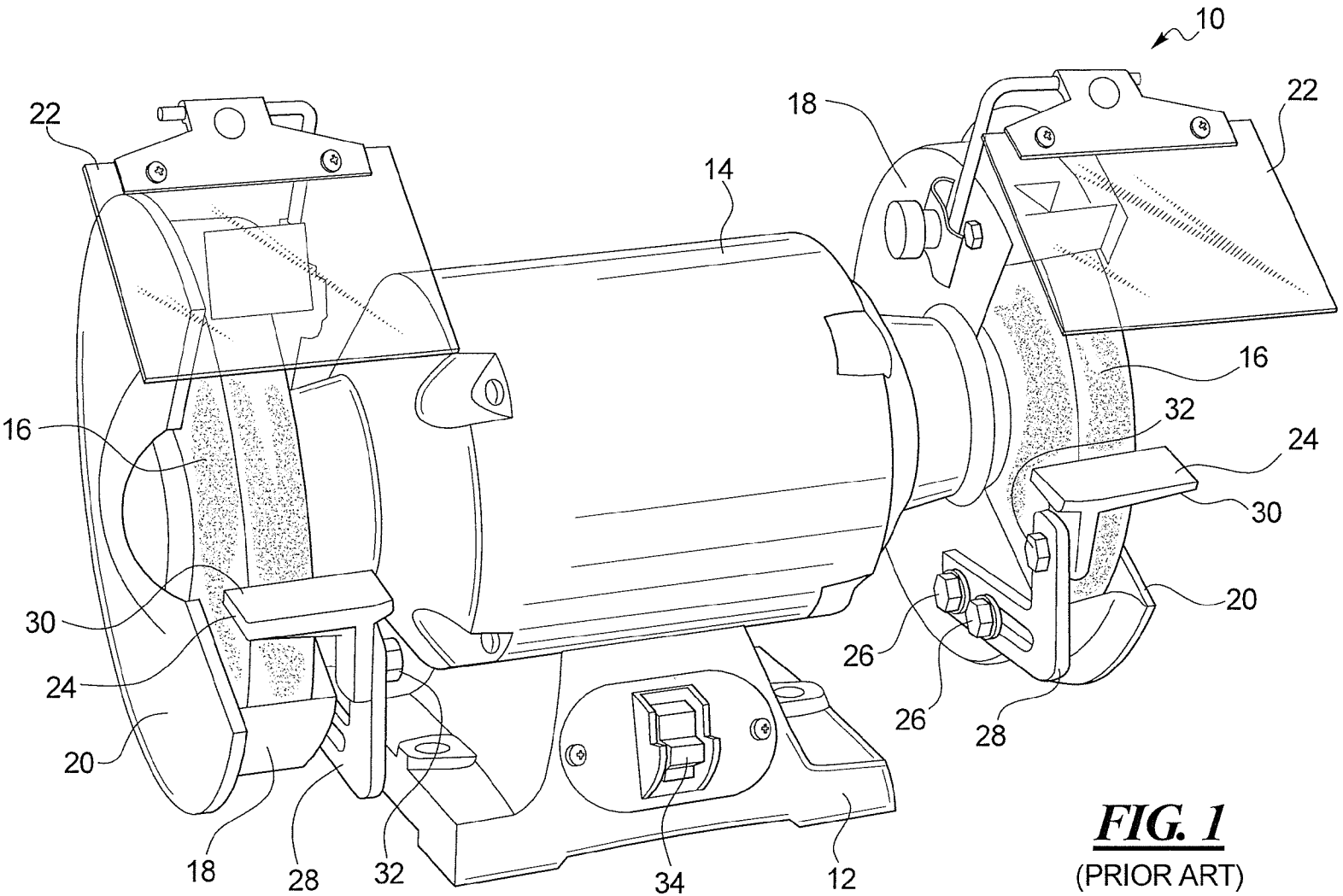
FIG. 1 (PRIOR ART)
FIG. 1 is a front perspective view of a bench grinder showing tool rests mounted at each of two grinding wheels.

Referring first to FIG. 1, a bench grinder 10 is shown. The bench grinder 10 includes a base 12 on which is mounted a motor housing 14 and which itself is mounted on a workbench or other surface. The motor housing 14 encloses a motor that has a motor shaft or arbor (not visible in this view) that extends from both ends of the motor housing 14. Grinding wheels 16 are mounted on each end of the motor shaft, thereby providing the bench grinder 10 with left and right grinding wheels. Each grinding wheel 16 is enclosed within a protective enclosure that is affixed to the motor housing 14. The grinding wheel enclosures each include a wheel guard 18 extending from the motor housing 14 to enclose an inside side and an outer perimeter of the grinding wheel 16, except for a working opening to access the wheel. A wheel cover 20 is affixed to the wheel guard 18 to enclose the outside side of each grinding wheel 16, also with a working opening. A transparent eye guard 22 is held in a support in position to shield the user's eyes while the user is using the bench grinder 10.

A tool rest 24 is provided for each grinding wheel 16. The tool rests 24 are affixed to the respective wheel guards 18 by being bolted to the inside surface of the respective wheel guard 18 by mounting bolts 26. The tool rests 24 each include an L-shaped bracket 28 to which is affixed a platform 30. Right and left tool rests 24 are connected to the respective right and left wheel guard 18.

The tool rests 24 are adjustable to move inward or outward relative to the axis of each grinding wheel 16 by loosening the bolts 26 to permit the L-shaped bracket 28 to slide to the desired position. This enables the tool rest 24 to be moved to maintain a desired spacing between the tool rest platform 30 and the grinding wheel 16 as the grinding wheel wears and when a new grinding wheel is mounted on the grinder 10. The tool rest 24 of the illustrated embodiment has an adjustable tool rest platform 30 that may be repositioned at different angles by loosening and then tightening a bolt 32 that connects the L-shaped bracket 28 and the platform 30. The bolt 32 requires use of a wrench for adjusting the position of the platform. Alternative tool rests are possible that are mounted on the bench or affixed to another part of the grinder.

The illustrated bench grinder 10 includes a power switch 34. The bench grinder 10 as shown in FIG. 1 is of a type that is currently available on the market. The grinder 10 may also include a speed control, spark guard, coolant reservoir, light, and/or other features. The illustrated bench grinder 10 has two grinding wheels 16. A single grinding wheel is possible, as are multiple grinding wheels. The motor 14 is in-line with the arbor of the bench grinder 10. It is possible that the motor may be provided separate from the grinding wheel axle, and connected thereto by a belt and pulley arrangement, for example. The bench grinder 10 may be combined with other tools on the same axle or arbor, such as a saw, sander, buffer or polisher, or other rotary tool.

It is foreseen that the tool rest of the present invention may be used on a belt grinder, a disk grinder, or other type of grinding tool. Any type of tool may be provided with the tool rest of the present invention.

Figure 2:
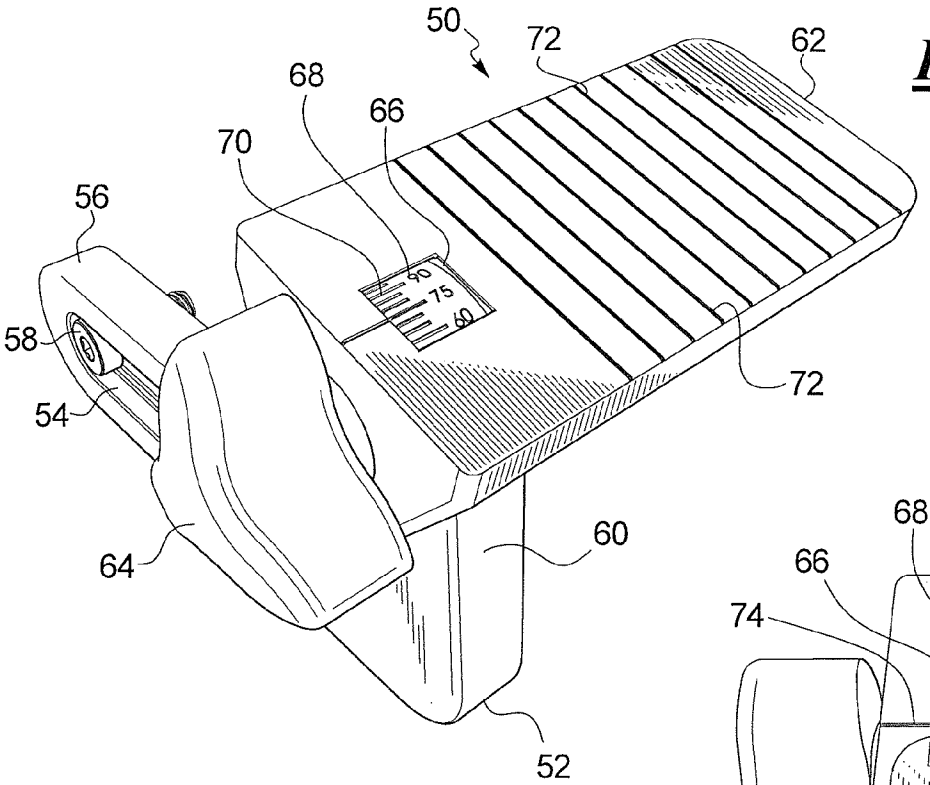
FIG. 2 is front left perspective view of a tool rest for use on a bench grinder such as the bench grinder of FIG. 1.
Figure 3:
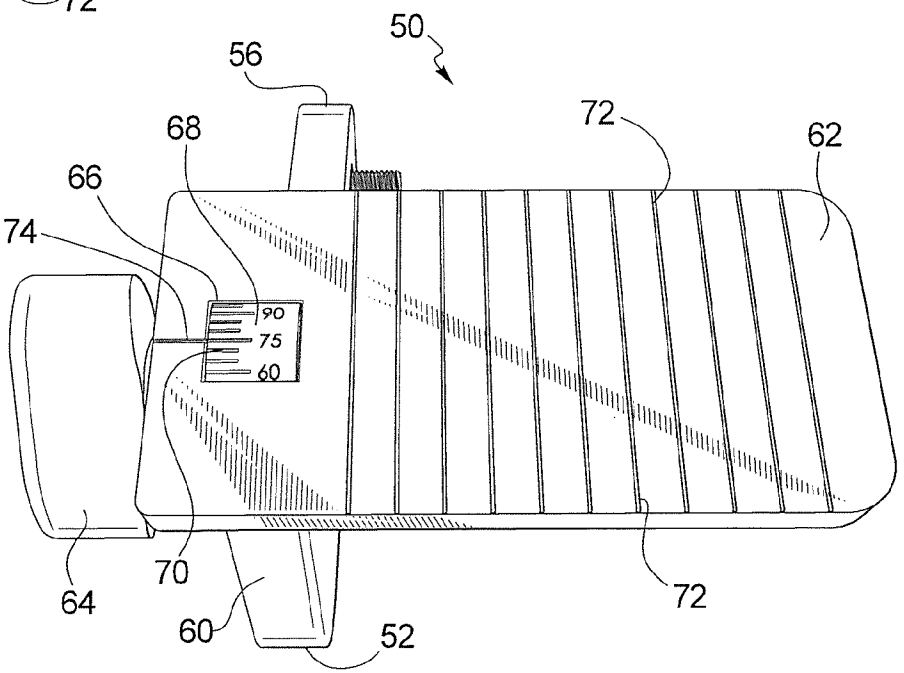
FIG. 3 is a front top perspective view of the tool rest of FIG. 2.

An improved tool rest 50 that includes an angle indicator is shown in FIG. 2. The tool rest 50 has an L-shaped bracket 52 for mounting on a wheel guard or other structure of a bench grinder, such as the bench grinder of FIG. 1. The L-shaped bracket 52 is configured for mounting on a right-side wheel guard of a right-side grinding wheel. A mirror image bracket may be provided for mounting on a left-side wheel guard of a left-side grinding wheel. The L-shaped bracket 52 includes a recess channel 54 in a first leg 56 of the bracket 52. A mounting bolt 58 is shown in the recess channel 54.

A second leg 60 of the L-shaped bracket 52 is affixed to a tool rest platform 62. The tool rest platform is held in position on the L-shaped bracket 52 by a hand bolt 64 that connects the platform 62 to the bracket 52. By loosening the hand bolt 64, the platform 62 may be pivoted relative to the bracket 52 and, once in the desired angular position, held in that position by tightening the hand bolt 64. The user may adjust the angle of the platform to the desired angle without use of a tool or other wrench.

An opening 66 is provided in the tool rest platform 62. The opening is disposed over the end of the leg 60 of the L-shaped bracket 52 to that the end 68 of the leg 60 is visible through the opening 66. The end 68 of the leg 60 is marked with angle indicator marks 70 that are visible through the opening 66 as the platform is pivoted. The user can thereby see the angle of the platform through the opening 66 in the top of the platform 62. The platform includes lines 72 marked or inscribed on its top surface. The lines of the illustrated embodiment are parallel to one another and parallel to the leg 56 of the bracket 52. The user may use the lines 72 to align a tool being sharpened or shaped to the grinding wheel. Other lines on the platform or other shapes of the platform surface may be provided as well. In one example, a groove is provided in the surface of the platform for holding drill bits during sharpening, for example.

With reference to FIG. 2, the tool rest platform 62 has the opening or window 66 to the left side above the end 68 of the leg 60 of the bracket 52. The opening of the illustrated embodiment is square, although other shapes are possible. An indicator line 74 is marked on the surface of the platform 62 extending to the opening 66. The indicator line 74 moves relative to the marks 70 on the end 68 that is visible through the opening 66 as the platform is pivoted to different angles. The indicator line 74 and the angle marks 70 are positioned relative to one another so as to indicate the angle that the platform assumes relative to the grinding wheel surface. Other angle relationships may be provided instead. The marks 70 indicate angles so that the angle of the platform 62 can be determined by examining the position of the indicator line 74 relative to the angle marks 70. The preferred embodiment has the angle marks 70 and the indicator line 74 marked in high contrast with the background surface to provide good visibility of the marks. For example, the end 68 of the leg 60 and the top surface of the platform may be polished metal and the angle marks 70 and indicator mark 74 may be etched into the surface and marked with paint or the like.

The end 68 of the leg 60 that is provided with the marks 70 is formed into a cylindrical wall portion. The cylindrical wall portion extends to just below the surface of the platform 62 to provide good visibility of the marks 70 and to reduce parallax between the marks 70 and the indicator mark 74. The underside of the platform 62 is shaped to accommodate the cylindrical wall portion of the end 68.

The hand bolt 64 can be seen extending from the left side of the tool rest 10. For a tool rest provided for a left-side grinding wheel, the hand bolt would extend from the right side and the platform would extend to the left from the L-shaped bracket. The left-side and right-side tool rests may be specifically formed for mounting only on one side of the bench grinder, or may be reversible to fit on either side. For a reversible tool rest, the angle marks 70 may be provided on both sides of the end 68 rather than only to the left side of the end as shown. The angle marks 70 are provided as shorter and longer marks to indicate angular intervals, as is well known.

Figure 4:
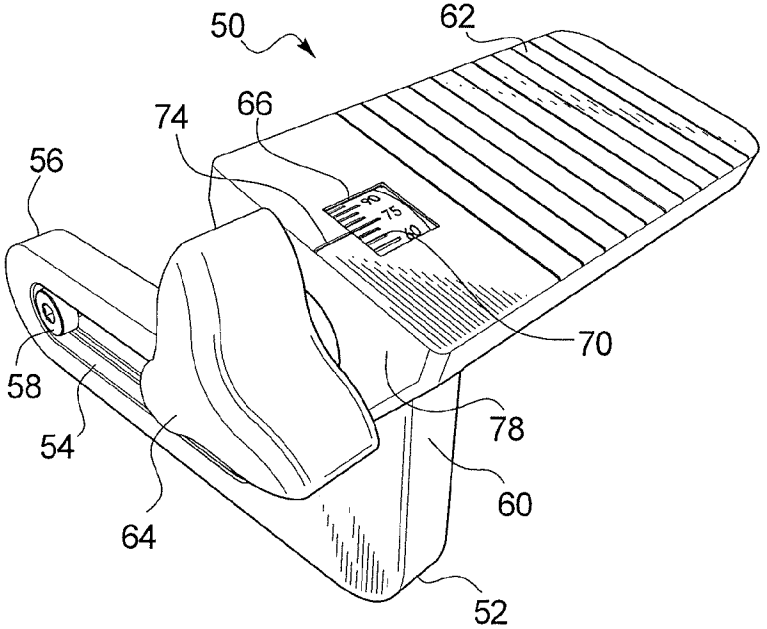
FIG. 4 is a left side perspective view of the tool rest of FIG. 2.

FIG. 4 shows the tool rest 10 generally from the side. The hand bolt 64 is of a generally triangular shape with three projections to aid in user manipulation of the bolt during angular adjustment of the platform 62. The head of the hand bolt 64 is ergonomically shaped in a preferred embodiment. The hand bolt 64 extends through an opening in a triangular downward projection 78 that extends below the top surface of the platform 62 and is disposed alongside the end 68 of the leg 60. The hand bolt 64 is threaded into a threaded bore in the leg 60 so that when the bolt 64 is tightened, it presses the triangular projection 78 of the platform 62 against the side of the leg 60 in side-by-side relation to hold the platform in the desired angular position. The surfaces between the triangular projection 78 and the leg 60 may be smooth, roughened, provided with radial grooves, or otherwise shaped. Smooth or roughened surfaces may provide continuous possible angular adjustments, whereas a grooved or other shaped interface between the parts may provide for non-continuous adjustment to only predetermined angles. For example, the grooves may permit adjustment in five degree increments.

The bolt 58 in the recess 54 is seen in this view. The head of the bolt 58 is within the recess so as to not to project out of the bracket 52. The bolt 58 may be an Allen head bolt or other similar bolt that does not require access to the outer surfaces to thread the bolt into secure engagement. The recess 54 includes a through extending slot through which the bolt extends into threaded engagement with the grinding wheel cover, for example.

Figure 5:
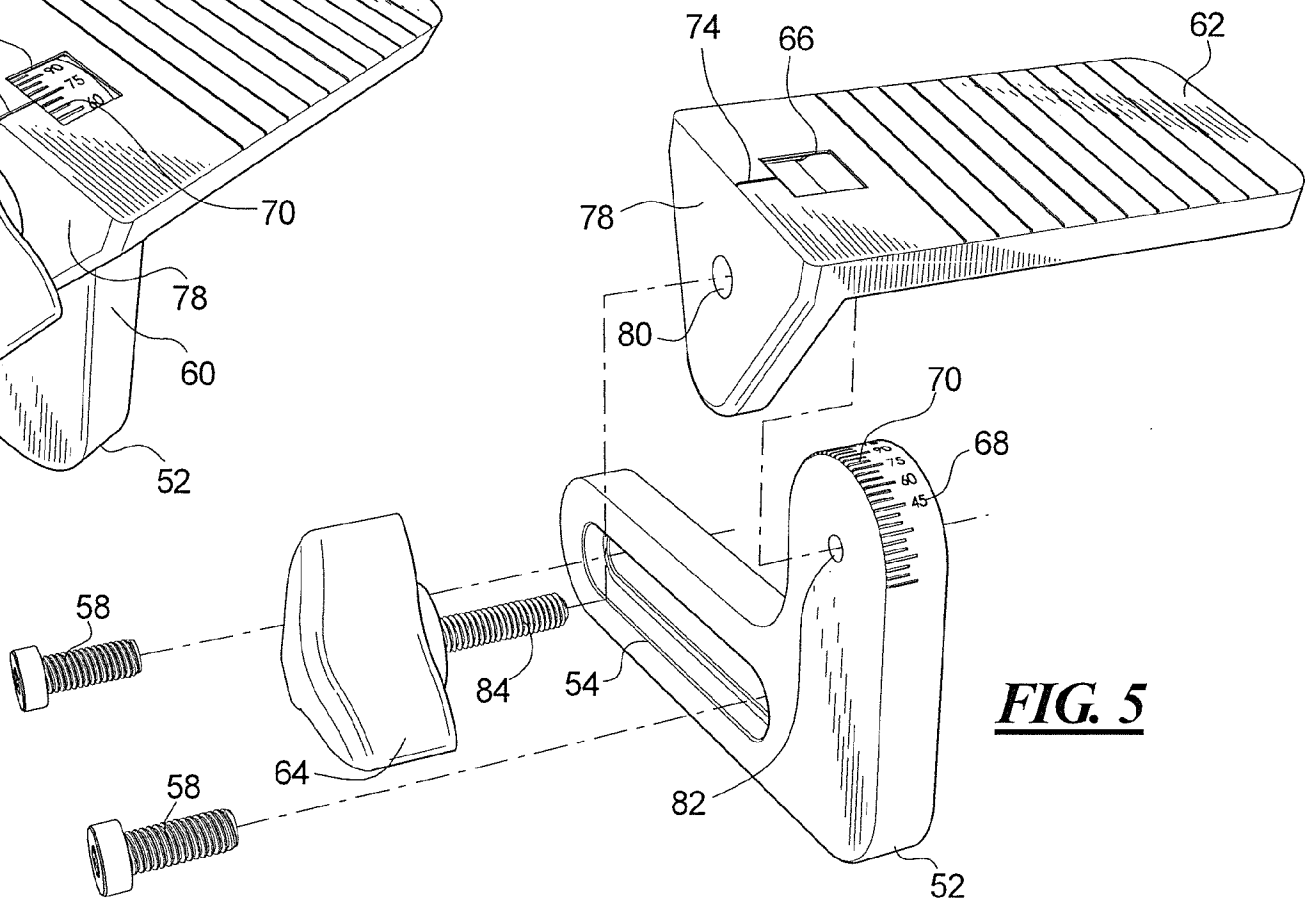
FIG. 5 is an exploded perspective view of the tool rest of FIG. 2.

Turning to FIG. 5, the tool rest 50 is shown in exploded view. The platform 62 has the triangular projection 78 through which extends the bore 80. The hand bolt 64 passes through the bore 80 and into a threaded bore 82 in the leg 60 of the L-shaped bracket 52. The hand bolt 64 includes an elongated threaded shaft 84 that passes through the bore 80 to secure the bracket 52 to the platform 62.

The channel 54 in the bracket 52 extends along the leg 56 to permit the screws 58 to be positioned along the channel 54 for adjustment of the bracket position relative to the grinding wheel cover and grinding wheel. Two screws 58 are provided, which pass through the slot that extends along the channel 54.

The bracket 52 has the cylindrical end 68 on which are marked the angle markings 70. The threaded bore 82 is provided along the axis of the cylindrical surface of the cylindrical end 68. Rotation of the platform about the shaft of the hand bolt 64 maintains the position of the angle markings within the opening 66. The underside of the platform 62 is provided with a recess at the opening 66 to accommodate the cylindrical end 68 fitting into position with the angle markings 70 disposed at or just below the surface of the platform 62.

Figure 6:
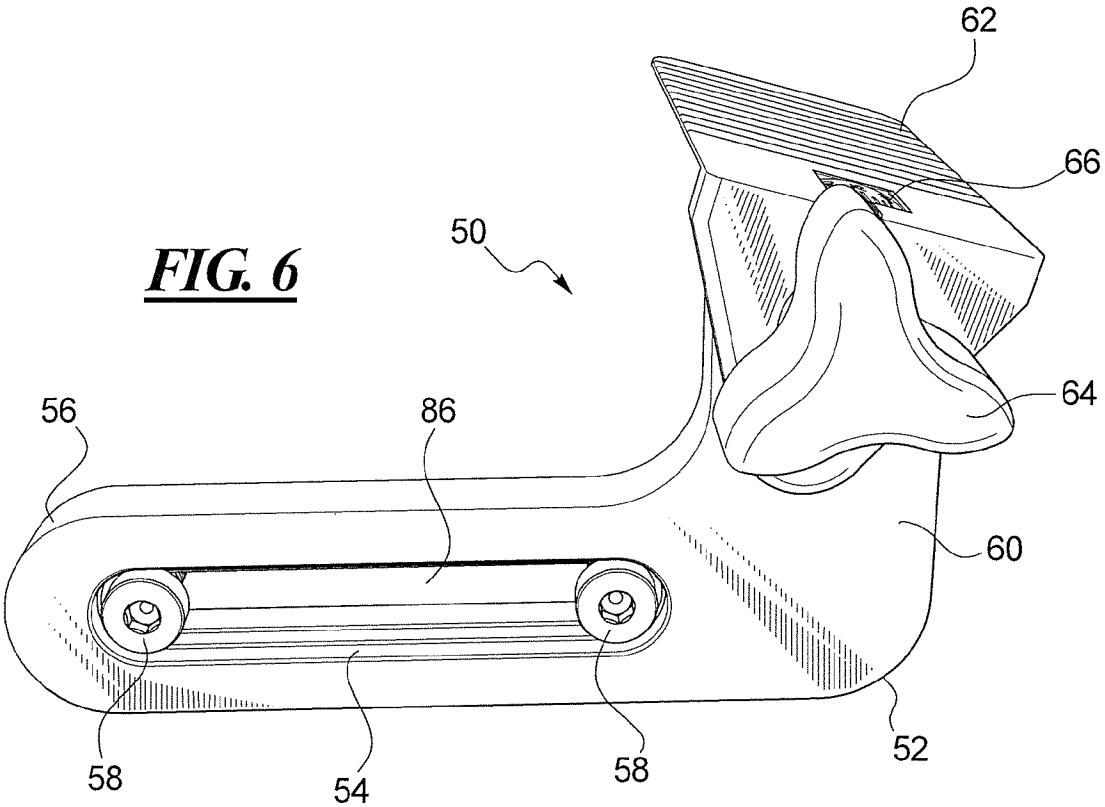
FIG. 6 is a side view of the tool rest of FIG. 2.

In FIG. 6, the bracket 52 has a slot 86 that extends along the arm 56 and within which the bolts 58 are positioned. The slot 86 has the recess 54 extending about the perimeter of the slot 86. The heads of the bolts 58 are disposed within the recess 54. In a preferred embodiment, the bolts do not project from the bracket 52. The bolts 58 are shown at the opposite ends of the slot 86. When mounted on a bench grinder, for example, the bolts 58 are more likely to be positioned along the slot 86 so that the bracket 52 may be adjusted to different positions relative to the axis of the grinding wheel.

The platform 62 as shown has been adjusted to an angle relative to the bracket 52, as can be seen by comparing the leg 56 to the platform 62. The bracket 52 is preferably affixed to the bench grinder or other tool in a horizontal position and the platform is preferably disposed at a vertical position so that when the platform is positioned at a horizontal position, the face of the grinding wheel at the tool rest is perpendicular to the tool rest platform. Adjustment of the angle of the platform 62 to a particular angle, results in the particular angle being added to or subtracted from perpendicular. A tool positioned on the tool rest will be shaped at the angle set by the tool platform.

Figure 7:
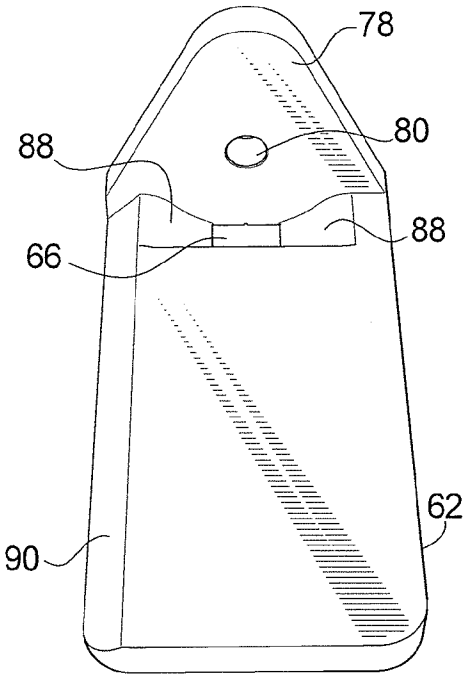
FIG. 7 is a bottom view of the platform portion of the tool rest of FIG. 2.

FIG. 7 shows the tool rest platform 62 from the underside with the bracket and bolts removed. The opening 66 through which the angle marks on the bracket are visible is shaped to accommodate the cylindrical surface on which the angle marks are provided. In particular, curved recess walls 88 extend on either side of the opening 66. The platform 62 includes a beveled front edge 90 at the edge facing the grinding wheel. The beveled edge 90 permits the tool rest to be adjusted to a position close to the grinding wheel at certain angles of the platform without risk that the platform will contact the grinding wheel.

In the illustrated embodiment, the platform is affixed to one side of the bracket (the left side in the illustrations) and extends over the end of the bracket to the other side (the right side in the illustrations). In an alternative embodiment, the platform is affixed to a side of the bracket to that the platform extends away from the bracket from that side. For example, and with reference to FIG. 5, the triangular projection 78 may be positioned against the right side of the bracket 52 and affixed there by the hand bolt 64. The platform 62 extends to the right of the bracket 52 rather than passing over the end as in the first-described embodiment. The cylindrical end 68 disposed at the end of the platform. In this position, the indicator mark 74 which extends to the end of the platform aligns with the angle marks 70 on the cylindrical end 68 to indicate the angle of the platform 62. In this embodiment, the hole through the platform is not needed for viewing the angle marks, and may be eliminated. The bore 80 through the triangular extension 78 of the platform 62 is threaded so that the hand bolt 64 may engage the threading.

In a further embodiment, the tool rest platform includes platform surfaces that extend from both sides of the bracket, for example, to both the right and left. The hand bolt may be disposed below one side of the platform surface in this embodiment. The hand bolt 64 may be replaced by a lever, toggle fastener, cam fastener, or other fastener in any of the embodiments described herein.

It is also contemplated that the angle indicator of the present tool rest may be applied to a tool rest that is supported by attachment to the workbench, to a housing of the grinder, to a coolant catch tray, or other support. The L-bracket may be replaced by other support members as required for the alternate tool rest support.

The tool rest 50 includes a visible angle indicator of the position of the platform. The angle indicator is visible from above the platform, so that it is in view while the user is using the bench grinder. In some embodiments, the tool rest 50 includes an opening through the top through which is visible the angle marks on the bracket to indicate to the user the angle of the platform. The tool rest has a cylindrically shaped end of the bracket that indicates an angle to a user relative to a position of the platform.

In an alternate embodiment, the angle markings are provided on the platform member and the indicator or indicator mark is provided on the bracket. For example, a portion of the platform may be shaped with a cylindrical surface portion marked with angle markings that are disposed adjacent an indicator on the bracket.

Thus, there is shown and described a simple and reliable indicator for the angle of the tool rest and a simple and reliable means for adjusting the angle of the tool rest. The user may sharpen a chisel, gouge, scissors, shears, or other tools at a predetermined angle without guessing at the angle or without requiring complex angle measuring devices.

Although other modifications and changes may be suggested by those skilled in the art, it is the intention of the inventors to embody within the patent warranted hereon all changes and modifications as reasonably and properly come within the scope of their contribution to the art.

We claim:

1. A tool rest for use with an abrading device, the abrading device having a guard positioned adjacent to an abrading element of the abrading device, comprising:

a support bracket having a first end and a second end, the first end being configured for mounting on the abrading device;

a first marked surface on the second end of the support bracket, the first marked surface on the second end of the support bracket being immovable relative to the first end of the support bracket;

a tool rest platform having a platform surface and a platform mounting portion, the platform mounting portion being attached to the second end of the support bracket, the platform mounting portion being selectively pivotable to a plurality of pivoted positions relative to the support bracket, the tool rest platform including a second marked surface, wherein the first and second marked surfaces indicate an angle of the tool rest platform when the tool rest platform is pivoted to at least two of the plurality of pivoted positions; and a releasable fastener operable to affix the platform mounting portion of the tool rest platform to the second end of the support bracket, the releasable fastener being capable of securing the tool rest platform to the support bracket in a plurality of different angular positions.

2. A tool rest as claimed in claim 1, wherein said first marked surface includes a cylindrical surface portion on the immovable second end of the support bracket, the cylindrical surface being marked with angle marks, and the second marked surface includes an indicator that moves relative to the first marked surface as the platform is pivoted relative to the support bracket.

3. A tool rest as claimed in claim 1, wherein the tool rest platform defines an opening in the platform surface, the first marked surface on the second end of the support bracket being visible through the opening in the tool rest platform surface.

4. A tool rest as claimed in claim 1, wherein the support bracket is an L-shaped bracket having a first portion including the first end configured for mounting on the abrading device, the L-shaped bracket having a second portion including the second end on which the tool rest platform is pivotably mounted, the second end having a cylindrical portion surface marked with angle marks as the first marked surface.

5. A tool rest as claimed in claim 1, wherein the releasable fastener includes a hand bolt.

6. A tool rest as claimed in claim 1, wherein the platform mounting portion of the tool rest platform extends substantially perpendicular to the platform surface, the platform mounting portion being fastened to the second end of the support bracket in side-by-side relation for pivotable movement between the platform mounting portion and the second end of the support bracket.

7. A tool rest for a bench grinder or the like, comprising:

a support bracket having a cylindrical surface portion marked with angle marks, the support bracket having a mounting portion configured for mounting to the bench grinder, the mounting portion being spaced from the cylindrical surface portion, the support bracket having a platform connecting portion adjacent the cylindrical surface portion;

a tool rest platform pivotally mounted to the platform connecting portion of the support bracket for pivoting movement relative to the support bracket, the tool rest platform defining an opening in the tool rest platform through which the angle marks of the cylindrical surface portion are visible to a user;

a hand bolt selectively fastening the tool rest platform to the support bracket, the hand bolt being constructed to selectively fasten the tool rest platform at ones of a plurality of different angles relative to the support bracket; and an indicator on the tool rest platform adjacent the opening, the indicator being aligned with ones of the angle marks at the ones of the different angles of the tool rest platform.

8. A tool rest for use with an abrading device, comprising:

a support bracket having a mounting portion configured for mounting to the abrading device and having an end extending from the mounting portion and spaced from the mounting portion;

a first marked surface on the end of the support bracket, the first marked surface being immovable relative to the support bracket;

a tool rest platform having a platform surface and a platform mounting portion, the tool rest platform including a second marked surface, wherein the first and second marked surfaces indicate an angle of the tool rest platform relative to the support bracket; and a releasable fastener constructed and operable to affix the platform mounting portion of the tool rest platform to the end of the support bracket so that the tool rest platform is spaced from the mounting portion of the support bracket, the releasable fastener being capable of securing the tool rest platform to the support bracket in a plurality of different angular positions.

* * * * *